United States Patent [19]

Otsuka et al.

[11] 4,294,367

[45] Oct. 13, 1981

[54] CONTAINER HAVING RIMMED SHRINK CAP

[75] Inventors: Chikao Otsuka; Reinosuke Hara, both of Kashiwa; Yoshito Shigenaka, Tokyo, all of Japan

[73] Assignee: Asahi Breweries Ltd., Tokyo, Japan

[21] Appl. No.: 39,888

[22] Filed: May 17, 1979

Related U.S. Application Data

[63] Continuation-in-part of Ser. No. 833,682, Sep. 15, 1977, abandoned.

[30] Foreign Application Priority Data

Sep. 21, 1976 [JP] Japan ..... 51-113317

[51] Int. Cl.[3] ..... B65D 41/54; B65D 41/62; B67B 5/00

[52] U.S. Cl. ..... 215/246; 215/253; 215/350

[58] Field of Search ..... 215/246, 273, 275, 363, 215/364, 349, 252–254, 256, 251, DIG. 2, DIG. 4, 350–352; 220/257, 359, DIG. 12; 206/497

[56] References Cited

U.S. PATENT DOCUMENTS

| | | | |
|---|---|---|---|
| 2,447,983 | 8/1948 | Little | 215/246 |
| 2,885,105 | 5/1959 | Heyl | 215/246 |
| 2,954,139 | 9/1960 | Owens | 215/246 |
| 3,189,208 | 6/1965 | Jowett | 215/246 |
| 3,274,013 | 9/1966 | Batt | 215/246 |
| 3,640,417 | 2/1972 | Sakurai | 215/246 |
| 3,720,343 | 3/1973 | Irish | 215/246 |
| 3,746,201 | 7/1973 | Fujio | 215/246 |
| 3,924,771 | 12/1975 | Cleff | 215/253 |
| 4,018,904 | 4/1977 | Muraoka | 206/497 |

FOREIGN PATENT DOCUMENTS

| | | | |
|---|---|---|---|
| 1070496 | 7/1954 | France | 215/253 |
| 640406 | 3/1962 | Italy | 215/246 |
| 406880 | 8/1966 | Switzerland | 215/273 |
| 28967 | of 1904 | United Kingdom | 215/246 |

*Primary Examiner*—Herbert F. Ross

*Attorney, Agent, or Firm*—Blanchard, Flynn, Thiel, Boutell & Tanis

[57] ABSTRACT

A container having a rimmed shrink cap closing the mouth thereof. The shrink cap comprises a cover made of a nonshrinkable material and having an outer diameter somewhat larger than the external diameter of the tubular mouth of the container. The shrink cap also comprises a tubular skirt portion made of a shrinkable material. The upper end of the tubular skirt portion has substantially the same outer diameter as that of said cover. The skirt portion of the cap is shrunk so that the lower portion of the skirt is in tight sealing contact with the neck of the container and the upper edge portion of the cap is formed in the shape of a laterally outwardly projecting rim. Because of the thus-formed rim, the cap can readily be twisted so that it can be removed from the tubular mouth of the container.

8 Claims, 4 Drawing Figures

CONTAINER HAVING RIMMED SHRINK CAP

CROSS-REFERENCE TO RELATED APPLICATION

This is a continuation-in-part of Ser. No. 833,682, filed Sept. 15, 1977, now abandoned.

BACKGROUND OF THE INVENTION (a) Field of the Invention

The present invention relates to a container having a tubular mouth, particularly a container having a tubular mouth of small diameter, and having a shrink cap that is shrunk on the mouth and neck portion of the container, so that it is in tight sealing contact with the exterior surface of the neck of the container.

(b) Description of the Prior Art

Shrink caps that are adapted to be used to seal the mouth and neck portions of containers are well known. These caps have been utilized on various kinds of containers having tubular mouth portions because they can prevent soil from adhering to the tubular mouth portions of the containers and they also are advantageous because the mouth portions are sterilized by the heat applied at the time of effecting shrinkage of the shrink cap. These conventional shrink caps are constructed such that their entire inner surfaces are shrunk onto the tubular mouth and neck portions of containers. Thus, such caps have to be removed from the tubular mouth and neck portions by pulling on a lug attached to the end of a perforation line that extends axially on the tubular cap from the inner end thereof to the cover thereof, whereby the cap can be split at the perforation. However, when conventional shrink caps are used, in particular, on containers having a small diameter tubular mouth and neck portion, it becomes extremely difficult to tear the shrink cap off at the perforation line because of various problems, such as, it is very difficult for the user to insert a fingernail under the cap so as to tear the perforation, and when the user tries to hold and twist the perforated portion with his fingers it is hard for the fingers to grasp the cap with sufficient force and consequently the fingers slip on the cap surface, and so forth. Therefore, users are often compelled to cut the perforated line with a knife or the like in order to remove the cap.

Accordingly, when it is necessary to seal, in particular, the small diameter mouth and neck portions of containers, for example, the mouth portions of containers for drinking water or the connected body of a syrup tank or the like, people have actually endeavored to keep the mouth portions clean by putting nonshrinkable caps thereon. However, the nonshrinkable caps are troublesome because they can readily be removed from the mouth portions so as to be lost in the course of transport, and they have to be washed with water and then sterilized for re-use.

SUMMARY OF THE INVENTION

An object of the present invention is to eliminate the aforesaid inherent drawbacks of the conventional caps.

Another object of the present invention is to provide a throwaway rimmed shrink cap that can be closely sealed by shrinkage, on the tubular mouth and neck portion of the container and simultaneously to form the outer edge portion thereof into the shape of a rim, thereby preventing contamination of the tubular mouth portion and further permitting easy removal of the cap by twisting the thus-formed rim.

A further object of the present invention is to facilitate removal of air at the time of shrinkage of the cap by the provision of a circumferential perforated line at the upper part of the skirt portion of the cap and also to facilitate removal of the cap after shrinkage by the provision of notches at the lower end of the skirt portion and perforated lines axially extending from said notches to the first-mentioned perforated line.

Additional objects of the present invention will be readily understood from the description given hereinafter.

As is evident from the above-mentioned objects, the present invention relates to a container having a tubular mouth and neck portion covered by a rimmed shrink cap that comprises a cover having an outer diameter somewhat larger than the diameter of the tubular mouth of the container and made of a nonshrinkable material and a tubular skirt portion having substantially the same outer diameter as that of said cover and made of a shrinkable material.

DETAILED DESCRIPTION OF THE INVENTION

Figure 1:
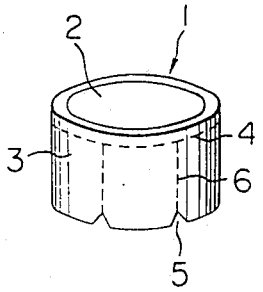
FIG. 1 is a perspective view illustrating one embodiment of the shrink cap, before shrinkage, according to the present invention.
Figure 2:
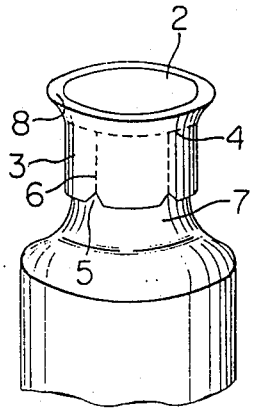
FIG. 2 is a perspective view illustrating the shrink cap, after shrinkage on the tubular mouth and neck portion of the container.
Figure 3:
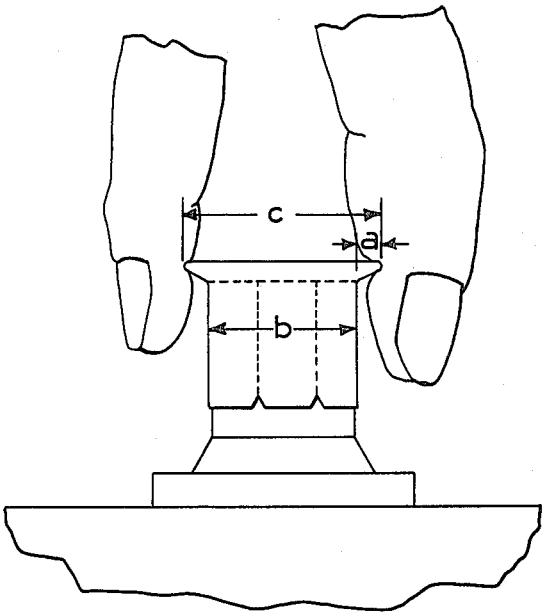
FIG. 3 is a fragmentary front view of the container and showing the user's fingers in position for twisting off the cap.
Figure 4:
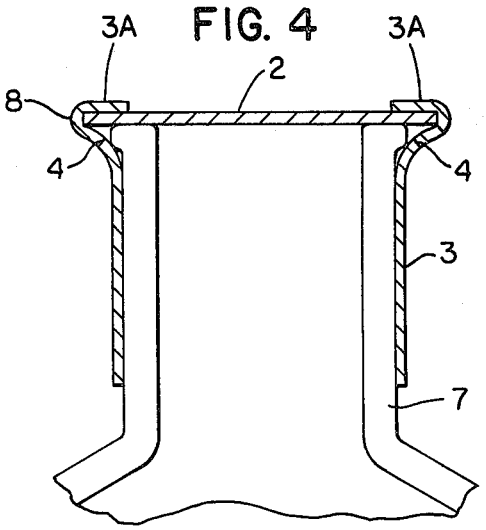
FIG. 4 is a central vertical sectional view through the mouth and neck portion of the container.

Referring to FIG. 1, the shrink cap 1, prior to shrinking, comprises a flat, disc-shaped, cover portion 2 and a tubular skirt portion 3 having substantially the same outer diameter as that of said cover portion 2. The upper end portion 3A of the skirt portion 3 overlaps and is affixed to the upper surface of the radially outer edge portion of the cover portion 2. The skirt portion 3 is made of a shrinkable material. The term "a shrinkable material" means a material prepared by stretching, while heating, a film or thin sheet of a thermoplastic resin such as polyvinyl chloride, polyethylene, polypropylene or the like. The thus-processed resin sheet, after it has been stretched to about 50 percent larger than its original size, is cooled so as to be formed in the desired shape of the skirt portion 3. When it is again heated, the sheet is usually capable of shrinking to about its original unstretched size. The cover portion 2 is preferably made of the same type of thermoplastic resin as the skirt portion 3, but the material of the cover portion 2 is not heat-shrinkable, such as is used for the skirt portion 3, but rather it is a nonshrinkable material that does not appreciably shrink when it is heated. As specific examples of this nonshrinkable material for the cover portion 2, there can be enumerated polyvinyl chloride, polyethylene, polypropylene, etc., and in this instance there can be utilized a vinyl chloride-laminated paper material. The skirt portion 3 is provided with a circumferential perforated line 4, through which air can pass, close to but spaced downwardly a small distance from the cover 2, that is, in the vicinity of the upper end of the skirt portion 3, and at least two notches 5 at the lower end of the skirt portion. Furthermore, the skirt portion is provided with two perforated lines 6 extending axially from the notches 5 at the lower end of the skirt portion 3 to the perforated line 4. These notches 5 and perforated lines 6 are usually preferably provided at 2 to 4 places on the circumference of the skirt portion.

The diameter of the cover portion of the shrink cap 1 is larger than the outer diameter of the mouth portion 7 of the container. In case the size difference therebetween is too small, there is formed a rim which is too narrow in radial width, while when said size difference is too large, undesirable results can occur. Accordingly, the amount of said size difference is required to be limited to a suitable range and less than the maximum shrinkage of the shrinkable material used. Generally speaking, the diameter of the shrink cap 1 is preferably established to be 10 to 40 percent, more preferably about 30 percent, larger than the outer diameter of the mouth portion 7.

The shrink cap 1 of the present invention is preferably used for the purpose of sealing, in particular, the tubular mouth portions of containers wherein the tubular mouth portions are of small diameter. The term "small diameter" referred to herein is employed in a relative sense and is not to be limited to a specific size. Also, it does not mean that the shrink cap as such cannot be used on large diameter mouth portions. The mouth portion of the shrink cap 1 can be not only of cylindrical shape, but also of square tubular shape. It is desired to shape the cap 1 so that it conforms to the shape of the tubular mouth 7.

In a preferred embodiment of the invention the external diameter "b" of the mouth portion of the container is from 5 to 40 mm, the diameter "c" of the shrink cap is from 10 to 40% larger than "b" and the radial width "a" of the laterally outwardly projecting rim 8 is at least 1 mm. The diameter "c" of the shrink cap is equal to the diameter of the cover disc 1 plus the thicknesses of the skirt portion that engage the radially outer edge of the cover disc.

If the diameter "b" of the mouth portion of the container is less than 5 mm, the radial width of the laterally outwardly projecting rim 8, formed by shrinking the skirt, will be so narrow that it will be difficult to remove the cap by twisting same with the fingers because the twisting force will be simultaneously applied to both the rim and the skirt portions because of the deformability of human flesh. On the other hand, when the diameter "b" of the mouth portion of the container is more than 40 mm, then other means, such as a lug, can easily be used to remove the cap. Thus, the invention finds its greatest usefulness for containers in which the mouth diameter "b" is from 5 to 40 mm.

The radial width "a" of the laterally outwardly projecting rim must be at least 1 mm in view of the fact that the diameter of the upper end of the cap including the rim is from 10 to 40% larger than the diameter "b" of the mouth of the container. Thus, when the user's fingers are pressed against the rim 8 for twisting same off, the radial width of the rim will be sufficiently large that the pressing and twisting force will be concentrated on the rim portion and little or none of the pressing and twisting force will be applied on the mouth of the bottle. Thus, the twisting force will be applied essentially only to the rim, whereas the lower portion of the skirt will remain stationary because of its frictional engagement with the neck of the bottle.

Further, it is preferred that the thickness of the shrinkable material-made skirt portion 3, inclusive of the upper end portion 3A, is from about 0.08 mm to about 0.15 mm, preferably 0.1 mm to 0.15 mm.

When the shrink cap 1 as shown in FIG. 1 is put on the tubular mouth portion 7 of the container and heated by infrared radiation, or with hot water, steam or the like, the skirt portion 3 made of a shrinkable material is thermally shrunk and becomes closely tightly sealingly engaged with the tubular mouth and neck portion 7. As this skirt portion 3 thermally shrinks, air present between the cap 1 and mouth portion 7 escapes through the perforated line 4. Further, even if the cap 1 is not initially coaxial with the mouth portion 7, it moves laterally so as to become coaxial with the mouth portion as the skirt portion shrinks. Also the external surface of the mouth and neck portion 7 becomes uniformly and completely sealed by the skirt portion. When the cap is subjected to shrinkage, the skirt portion 3 made of shrinkable material is thermally shrunk and becomes tightly secured around the mouth portion 7, whereas the cover 2 made of a nonshrinkable material does not significantly shrink. Since the diameter of the cover 2 is 10 to 40% larger than that of the mouth portion, the outer edge portion 8 of the cover 2 projects outwardly from the mouth portion by a distance "a" equivalent to the difference between the diameter of the cover and that of the mouth portion. The projecting outer edge portion 8 of the cover forms a rim after shrinkage.

The removal of the cap 1 is effected in such a manner that by grasping the rim 8 and twisting the cap, a shearing force is applied on the rim 8 and when the notches 5 and the perforated lines 6 are provided on the skirt portion 3, the shearing force is focused on the notches 5 and is then transferred therefrom to the axially extending perforated lines 6 to readily break it off, whereby the cap 1 can be removed from the mouth portion 7.

The embodiments of the invention in which an exclusive property or privilege is claimed are defined as follows:

1. In combination with a container having a tubular neck and a mouth at the upper end of said neck, a rimmed shrink cap comprising a disc-shaped cover having a diameter which is from 10 to 40% larger than the outer diameter of the mouth of the container, said cover being made of a nonshrinkable material, a tubular skirt overlying the top surface of said cover and extending downwardly from the perimeter of said cover, said skirt being made of a heat-shrinkable material, said cap being positioned so that said cover is substantially concentric with and overlies and closes the mouth of the container, and the lower portion of said skirt surrounds the tubular neck of the container and is heat-shrunk into tight sealing contact with the exterior wall of the tubular neck of the container below the mouth, the outer edge portion of said disc-shaped cover projecting radially outwardly beyond the outer edge of the mouth and forming an annular rim above said mouth, the upper portion of said skirt being exposed to but spaced outwardly from the outer edge of said tubular mouth and the outer surface of the portion of said neck adjacent to said mouth, said rim allows said cap to be readily torn off with ones fingers.

2. The combination according to claim 1 wherein said tubular skirt is provided with a circumferentially extending line of perforations for permitting discharge of air in the vicinity of the cover, said skirt having notches in its lower edge, and axially extending lines of perforations extending from said notches to said circumferential line of perforations for removing the cap.

3. The combination according to claim 2 wherein the notches and the axially extending lines of perforations are provided at from 2 to 4 places on said skirt portion.

4. The combination of claim 1 wherein said tubular mouth has an outer diameter of from 5 to 40 mm and wherein the lateral width of said rim, which is equal to the lateral distance between the outer edge of said mouth and the outer edge of said cover, is at least 1 mm.

5. In combination with a container having a tubular neck ending in a tubular mouth, a closure for said tubular mouth comprising a cover disc made of a nonshrinkable material and overlying and closing said mouth, said cover disc having a diameter which is from 10 to 40% larger than the outer diameter of said tubular mouth so that the laterally outer portion of said cover disc projects radially outwardly beyond the outer wall of said mouth, a cylindrical skirt extending from the perimeter of said cover disc with the lower portion of said skirt being heat-shrunk onto the sidewall of said neck in sealed relationship therewith, the upper portion of said skirt smoothly flaring upwardly and outwardly to meet the perimeter of said cover disc and overlie the top surface of said cover disc above said mouth and with said cover disc perimeter forming a manually twistable rim on the closure, a single, circumferentially extending line of perforations through said skirt at the location thereon whereat said upper portion of said skirt begins to flare away from said neck, at least one pair of circumferentially spaced, axially extending lines of perforations extending downwardly from said location where said skirt begins to flare away from said neck and terminating in notches in the lower edge of said skirt for shearing of said skirt along said axially extending lines in response to twisting of said rim, whereby said rim allows said closure to be readily torn off with ones fingers.

6. The combination of claim 5, wherein said tubular mouth has an outer diameter of from 5 to 40 mm. and wherein the lateral width of said rim, which is equal to the lateral distance between the outer edge of said mouth portion and the outer edge of said cover disc is at least 1 mm., said skirt having a thickness of from about 0.08 mm. to about 0.15 mm.

7. The combination of claim 6, in which the diameter of said cover disc is about 30% greater than the outer diameter of said tubular mouth.

8. The combination of claim 5, in which said neck has a smooth, substantially cylindrical outer surface free of outward projections below said mouth, said mouth having an outside diameter exceeding said neck outside diameter, said cover disc periphery and therewith the heat shrunk skirt being both spaced radially outward from the outer surface of said mouth and forming said rim against which the fingers of the user can press radially inward without forcing the skirt or cover frictionally against the radially outer surface of the mouth for twisting the upper portion of the cap on said neck.

* * * * *